US007971727B2

(12) United States Patent
Gnann et al.

(10) Patent No.: US 7,971,727 B2
(45) Date of Patent: Jul. 5, 2011

(54) BLOCKING SLIDE UNIT OF A FEED AND SORTING DEVICE FOR PACKAGING MACHINES

(75) Inventors: Kurt Gnann, Biberach (DE); Martin Zuleger, Achstetten (DE)

(73) Assignee: Uhlmann Pac-Systeme GmbH & Co. KG (DE)

( * ) Notice: Subject to any disclaimer, the term of this patent is extended or adjusted under 35 U.S.C. 154(b) by 175 days.

(21) Appl. No.: 12/421,992

(22) Filed: Apr. 10, 2009

(65) Prior Publication Data

US 2009/0263227 A1 Oct. 22, 2009

(30) Foreign Application Priority Data

Apr. 16, 2008 (EP) ..... 08007417

(51) Int. Cl.
*B07B 1/49* (2006.01)

(52) U.S. Cl. ..... 209/391; 209/240; 209/255; 209/270; 209/284; 53/246; 53/248

(58) Field of Classification Search ..... 209/240, 209/255, 270, 284; 53/246, 248, 235
See application file for complete search history.

(56) References Cited

U.S. PATENT DOCUMENTS

| | | | | |
|---|---|---|---|---|
| 2,108,906 | A * | 2/1938 | Speckhart et al. | 53/282 |
| 4,685,271 | A | 8/1987 | Ringer et al. | |
| 4,693,057 | A * | 9/1987 | Rittinger et al. | 53/539 |
| 4,761,932 | A * | 8/1988 | Harvey et al. | 53/329.2 |
| 5,737,902 | A * | 4/1998 | Aylward | 53/475 |
| 7,318,304 | B2 * | 1/2008 | Hiddink et al. | 53/246 |
| 7,818,950 | B1 * | 10/2010 | McGonagle et al. | 53/474 |
| 2008/0236100 | A1 * | 10/2008 | Gnann et al. | 53/246 |

FOREIGN PATENT DOCUMENTS

| | | |
|---|---|---|
| EP | 0224017 A1 | 8/1987 |
| EP | 1391386 A2 | 2/2004 |

* cited by examiner

*Primary Examiner* — Terrell H Matthews
(74) *Attorney, Agent, or Firm* — Jansson Shupe & Munger Ltd.

(57) ABSTRACT

A feed and sorting device for tablets has a number of vertically extending filling tubes for tablets, and a blocking slide unit for temporarily blocking the guiding channels of the filling tubes. The blocking slide unit includes a base plate with through-openings for the filling tubes and a plurality of blocking fingers designed as integral parts of the base plate and horizontally extending into the through-openings. Each blocking finger is assigned to one of the filling tubes.

12 Claims, 8 Drawing Sheets

BLOCKING SLIDE UNIT OF A FEED AND SORTING DEVICE FOR PACKAGING MACHINES

CROSS REFERENCE TO RELATED APPLICATION

This application claims priority based on European patent application EP 08 007 417.2, filed Apr. 16, 2008.

FIELD

The field relates generally to blocking slide units of feed and sorting devices for packaging machines and, more particularly, to blocking slide units of feed and sorting devices for tablets, capsules, dragées, or the like, especially on thermoforming machines.

BACKGROUND

Conventional blocking slide units of feed and sorting devices with filling tubes for tablets, capsules, dragées, or the like, especially on thermoforming machines, comprise a number of blocking fingers corresponding to the number of filling tubes, each of these fingers being assigned to one of the filling tubes, and a base plate with a number of through-openings, wherein the base plate comprises sockets for the blocking fingers. In the case of the conventional blocking slide units, the sockets for the blocking fingers are milled into the surface of the base plate.

During the production of the conventional blocking slide units of feed and sorting devices, this leads to a first disadvantage that, because of the large number of individual parts, a relatively long period of time is required to assemble the blocking slide units in addition to which, because of the very small geometric forms and the large number of sockets, a long machine operating time is required to produce them. During the handling of conventional blocking slide units, this leads to the second disadvantage that, because the sockets do not pass all the way through the base plate but are introduced only into its top surface, they make these units very difficult to clean. Because of their geometry, the corners of these sockets cannot be adequately cleaned, and, as a result, residues can remain behind on the base plate.

SUMMARY

It is an object to provide feed and sorting devices for tablets, capsules, dragées, etc., especially on thermoforming machines for blister packages, with a blocking slide unit which can be manufactured quickly and at low cost and which can be cleaned effectively.

According to an embodiment, the feed and sorting device for tablets, capsules, dragées, or the like, comprises a number of vertically extending filling tubes each of them having a guiding channel for tablets, capsules, dragées, or the like, and a blocking slide unit for temporarily blocking the guiding channels of the filling tubes, the blocking slide unit comprising a base plate with through-openings for the filling tubes, and a plurality of blocking fingers designed as integral parts of the base plate and horizontally extending into the through-openings, each blocking finger being assigned to one of the filling tubes.

Thus, the blocking fingers can be produced together with the base plate more quickly and at lower cost, because there is no need for a milling cutter to produce the sockets for the blocking fingers, which involves considerable time and expense, nor is there any need to produce the blocking fingers first in a separate production step and then to introduce them into the sockets. Another advantage is that the blocking fingers can be formed on the base plate at the same time that the through-openings are produced. The blocking fingers, furthermore, are connected to each other individually or in groups, which simplifies the production of the blocking slide unit. Another advantage is that the conventional sockets for the fingers can be eliminated, as a result of which the blocking slide units can be cleaned more effectively and more quickly.

In the blocking slide unit of feed and sorting devices, a plurality of blocking fingers is preferably assigned to each of the through-openings in the base plate. As a result, manufacturing can be completed more quickly, and a simpler design is also obtained, which is especially advantageous for cleaning operations.

In addition, the base plate with the blocking fingers can be made of a solid material, especially of steel, aluminum, or plastic, as a result of which the service life and load capacity of the feed and sorting device are improved in particular.

The base plate with the blocking fingers, furthermore, can comprise a soft coating, especially a silicone coating. This leads, first, to the fact that sensitive materials are sorted more gently, and second, this has the effect of reducing the accumulation of contaminants. This is an important aspect especially in cases where drugs or food products are involved.

According to another exemplary embodiment of the blocking slide unit, these advantages are achieved in that the base plate with the blocking fingers is formed out of a soft material, especially silicone.

The base plate, furthermore, can comprise a number of partial base plates, since dividing the base plate into a number of partial base plates makes handling easier.

In yet another embodiment, the base plate is arranged above a lower retaining plate, and at least one fastening means for fastening the base plate to the lower retaining plate is attached to the lower retaining plate. This offers the advantage that the base plate can be easily set at the desired distance.

It has been found advantageous for the fastening means to comprise a locking projection, wherein a locking and release opening in the base plate is assigned to the locking projection in such a way that the base plate can be detached from or locked in position on the lower retaining plate by shifting the lower retaining plate relative to the base plate. As a result, the base plate can be attached and released quickly and reliably.

Preferably a clamping device such as a plastic clip is used for the purpose of attachment. In this way, the base plate is prevented from slipping out of position during operation.

Alternatively, a blocking slide unit can comprise an upper retaining plate, below which the base plate is arranged and on which at least one fastening means is attached for fastening the base plate to the upper retaining plate, as a result of which the base plate can be set at the desired distance.

It has been found favorable for the fastening means to comprise a locking projection, wherein a locking and release opening in the base plate is assigned to the locking projection in such a way that the base plate can be detached from or locked to the upper retaining plate by shifting the base plate in the locking and release opening relative to the upper retaining plate, as a result of which the base plate is prevented from slipping out of position during operation.

According to another embodiment of the blocking slide unit, instead of the base plate, a corresponding lower base plate with lower through-openings and a corresponding upper base plate with upper through-openings are present, wherein the lower base plate and the upper base plate are arranged with respect to each other in such a way that each lower through-opening and the corresponding upper through-opening are assigned to a corresponding number of filling tubes.

The blocking slide unit preferably comprises at least one guide part with a lower guide for guiding the lower base plate and an upper guide for guiding the upper base plate, wherein the minimum of one guide part, the lower base plate, and the upper base plate are arranged between a lower cover plate and an upper cover plate. As a result, the base plates can be moved with precision in the blocking slide unit. The guide parts, furthermore, can be inserted into the upper cover plate and the lower cover plate and thus easily held in place, which speeds up the assembly and disassembly processes and simplifies cleaning.

It has been found advantageous for the coding of the lower base plate for the lower guide to be different from the corresponding coding of the upper base plate for the upper guide. As a result of the differences in the codings of the guides and the corresponding differences in the codings of the upper and lower base plates, it is possible to prevent the base plates from being confused with each other.

It is especially preferable for the lower base plate to comprise a first height and for the upper base plate to comprise a second height, wherein the first height differs from the second height, and for the lower guide be formed as a lower guide groove with a width which accommodates the first height and for the upper guide to designed as an upper guide groove with a width which accommodates the second height. As a result of the asymmetry of the dimensions, a simple mechanical means is provided which prevents the lower and upper base plates from being confused with each other during assembly.

According to another aspect of the present invention the guide part comprises a first lock on the side facing the upper cover plate and a second lock on the side facing the lower cover plate, such that the first lock and the second lock are different, wherein a first key for the first lock is formed on the side of the upper cover plate facing the guide part for establishment of a connection with the guide part, and a second key for the second lock is formed on the side of the lower cover plate side facing the guide part for establishment of a connection with the guide part. If the guide part has an asymmetric design, confusion during assembly can be prevented automatically.

In an advantageous exemplary embodiment, the first lock is designed as an upper guide projection on the top surface of the guide part; the second lock is designed as a lower guide projection on the bottom surface of the guide part; the first key on the bottom surface of the upper cover plate is designed as an upper guide opening accommodating the upper guide projection; and the second key on the top surface of the lower cover plate is designed as a lower guide opening accommodating the lower guide projection. In addition and/or alternatively, other types of codings, such as, for example, a magnetic coding, are also possible, instead of a mechanical coding, to differentiate the upper from the lower surface of the guide part and to fit them appropriately to the different opposing pieces on the lower and the upper cover plates.

According to another embodiment, the upper base plate is arranged so that it is movable relative to the lower base plate, wherein an end position of the upper base plate is designed so that it is adjustable. This makes it easier to compensate for tolerances associated with manufacturing, construction, and operation.

The blocking slide unit preferably comprises a pneumatic cylinder to move the upper base plate and a stop for limiting the movement of the upper base plate, wherein the stop is designed so that it can be adjusted by a motor.

In yet a further embodiment, a process for producing a base plate for the blocking slide unit described above is provided. The blocking fingers are formed as integral parts of the base plate. In this way, the base plate can be produced together with the blocking fingers more quickly and at lower cost, because there is no need for a milling cutter to produce the sockets for the blocking fingers, which is time-consuming and expensive, nor is there any need to produce the blocking fingers first in a separate production step and then to introduce them into the sockets. An additional advantage is that the blocking fingers can be produced at the same time that the through-openings are formed in the base plate.

In certain embodiments, two blocking slide units are connected to each other in such a way that their through-openings are aligned with each other, wherein the blocking fingers of the two blocking slide units are arranged differently from each other, so that the blocking fingers of the blocking slide unit assigned to one set of through-openings are offset from the fingers of the blocking slide unit assigned to the other set. In this way, the tablets, capsules, dragées, etc., can be oriented more effectively and thus the processing speed is increased.

According to yet another aspect of the blocking slide unit of feed and sorting devices, the blocking slide unit comprises a lower base plate according to one of the preceding aspects and an alternative embodiment of the upper base plate different from the lower base plate, this upper base plate being referred to in the following as the "alternative" base plate. The elements which pertain to the alternative base plate, furthermore, will be designated correspondingly as "alternative" elements.

In the alternative base plate, the alternative blocking fingers are not designed as integral parts of the alternative base plate; instead, alternative receiving sections or recesses for the alternative blocking fingers passing all the way through the alternative base plate are formed, and the alternative base plate is arranged between an alternative lower retaining plate with through-openings and an alternative upper retaining plate with through-openings in such a way that the alternative blocking fingers are secured in the alternative receiving sections of the alternative base plate, wherein both the through-openings of the alternative lower retaining plate and the through-openings of the alternative upper retaining plate are assigned to the through-openings of the alternative base plate.

Thus, the alternative receiving sections for the alternative blocking fingers can be produced more quickly and at lower cost, because, first, the alternative receiving sections do not have to be produced by a complicated process involving a milling cutter but can be produced instead by means of a laser cutting installation. Depending on the selected materials, furthermore, it may also be possible to use stamping processes, casting processes, injection-molding processes, or even rapid prototyping processes. In addition, because of the arrangement of the alternative lower retaining plate and the alternative upper retaining plate, the alternative blocking fingers are secured in the alternative receiving sections, even though the alternative sockets are designed to pass all the way through the alternative base plate. Another advantage is that the alternative receiving sections for the alternative blocking fingers can be formed at the same time that the through-openings are produced in the alternative base plate.

In the case of the blocking slide unit of feed and sorting devices, a plurality of alternative blocking fingers is preferably assigned to the through-openings in the alternative base plate. As a result, the speed of production is increased, and the structure is simplified, which is advantageous especially with respect to cleaning operations.

In addition, the alternative receiving sections for the alternative blocking fingers of the blocking slide unit can have a narrowed section at the end where they connect to the through-openings. In this way, the alternative blocking fingers are held in place more effectively during the operation of the blocking slide unit.

It is advantageous for the alternative blocking fingers to consist of a solid material, especially steel, aluminum, or plastic, as a result of which the service life and load capacity of the feed and sorting device are improved in particular.

The alternative blocking fingers, furthermore, can comprise a soft coating, especially a silicone coating. The means, first, that sensitive materials are sorted more gently, and second, that the accumulation of contaminants is reduced. This is an especially important aspect in cases where drugs or food products are involved.

These advantages can also be achieved by forming the blocking fingers out of a soft material, especially silicone.

The alternative base plate, furthermore, can comprise a number of alternative partial base plates, for the reason that dividing the alternative base plate into a number of alternative partial base plates makes handling easier.

In the blocking slide unit according to the present invention, the arrangement of the alternative base plate and of the base plate according to one of aspects can also be exchanged, so that this base plate can be designed as an upper base plate and the alternative base plate as a lower base plate.

BRIEF DESCRIPTION OF THE DRAWINGS

Exemplary blocking slide unit of a feed and sorting device for packaging machines may be understood by reference to the following description taken in conjunction with the accompanying drawings, in which like reference numerals identify like elements throughout the different views and embodiments.

DETAILED DESCRIPTION

For the filling of blister packages, the tablets are usually sorted into vertically extending filling tubes 10 (FIG. 5) of a feed and sorting device by upward and downward movement of the bottom of a sorting plate (not shown) arranged above filling tubes 10. The filling tubes 10 are designed to provide a proper orientation of he tablets. The tablets, which are arranged in a stack in filling tubes 10, must further be singled out so that only individual tablets are fed to each pocket of a blister package. This separation process of single tablets in filling tubes 10 is performed by a blocking slide unit having horizontally extending blocking fingers 1 (FIG. 1) which are moved out of and back into the guiding channel of filling tubes 10. In this way, blocking fingers 1 block the guiding channel in their inserted position, while they allow exactly one tablet per filling tube 10 to fall down in their removed position.

Figure 1:
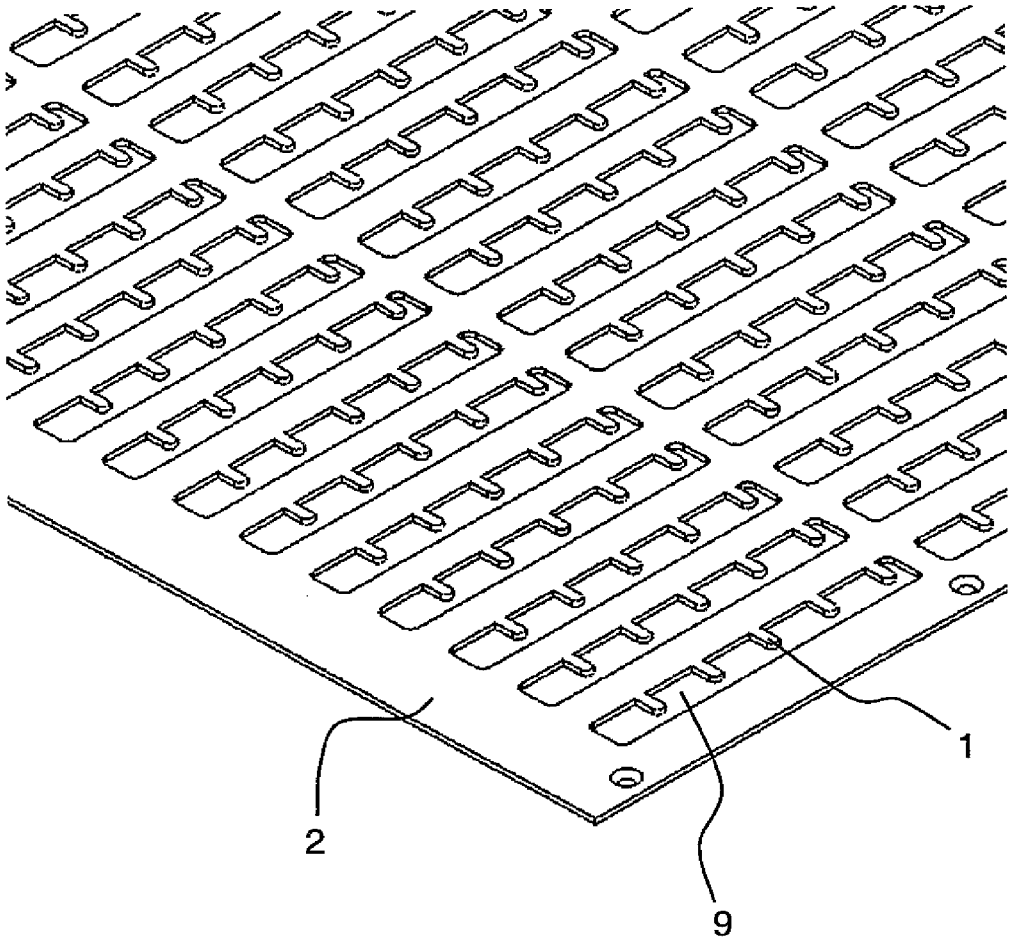
FIG. 1 is a perspective view of a base plate of a blocking slide unit of a feed and sorting device according to a first exemplary embodiment.

FIG. 1 shows a base plate 2 for a first exemplary embodiment of a blocking slide unit of a feed and sorting device with filling tubes 10 for tablets, capsules, dragées, etc., especially on thermoforming machines. Base plate 2 comprises blocking fingers 1, the number of which corresponds to the number of filling tubes 10, each blocking finger being assigned to its associated filling tube 10, and through-openings 9, wherein blocking fingers 1 are designed as integral parts of base plate 2.

Blocking fingers 1 in base plate 2 can be produced in base plate 2 together with through-openings 9 by means of a stamping process, a casting process, an injection-molding process, a laser process, or a rapid-prototyping process. As shown in FIG. 1, it is preferable for a plurality of blocking fingers 1 to be assigned to each through-opening 9.

Figure 2:
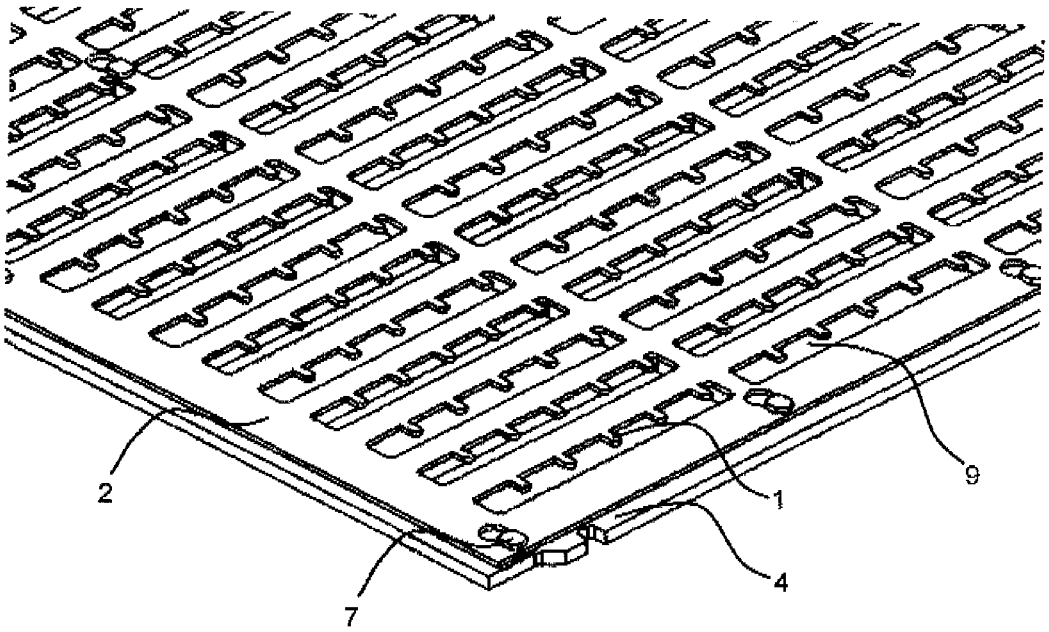
FIG. 2 is a perspective view of a base plate with a lower retaining plate and fastening devices according to a second exemplary embodiment.

FIG. 2 shows base plate 2 with blocking fingers 1 in the state in which it is locked to a lower retaining plate 4, wherein the components which are the same as those of the first exemplary embodiment are designated by the same reference numbers. For a detailed description of them, reference is made to the descriptive sections of the first exemplary embodiment.

In the state in which base plate 2 with the through-openings 9 is locked to lower retaining plate 4 by means of a fastening device, it is preferably attached in such a way that these through-openings essentially coincide with the through-openings in lower retaining plate 4.

Figure 3:
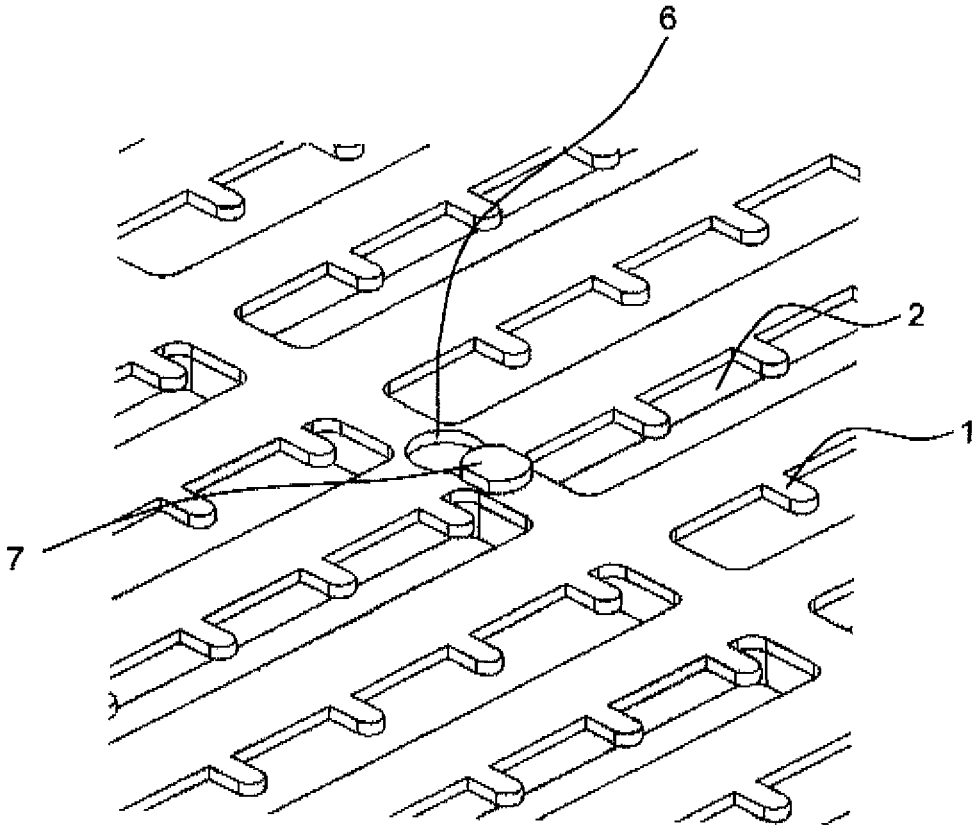
FIG. 3 is an enlarged perspective view of the fastening device of FIG. 2 in the locked state.
Figure 4:
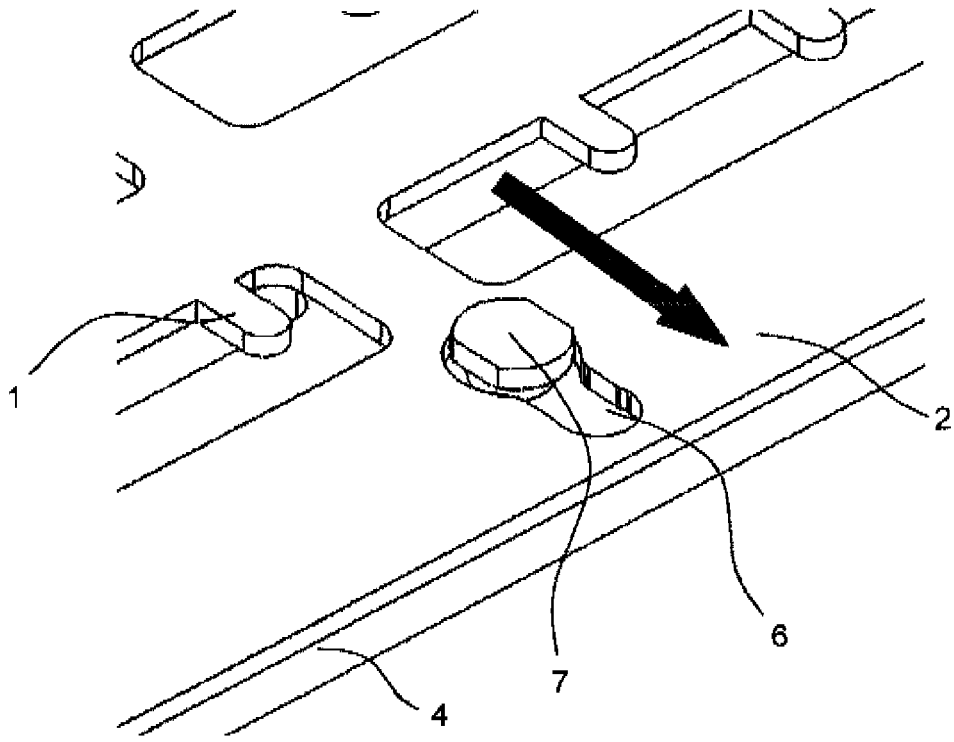
FIG. 4 is an enlarged perspective view of the fastening device of FIG. 2 in the released state.

FIG. 3 shows an enlarged diagram of the fastening device in the locked state, and FIG. 4 shows the fastening device in the released state. In the locked state, a locking projection 7, which is arranged on lower retaining plate 4, and which comprises a neck part and a head part, is located in a narrowed section of the locking and release opening 6 in base plate 2, so that the head part of locking projection 7 secures base plate 2 to lower retaining plate 4. In the released state, however, locking projection 7 is located in the widened section of the locking and release opening 6 in base plate 2, so that base plate 2 can be removed from lower retaining plate 4 by pulling it over the head part. The arrow in FIG. 4 shows the direction in which locking projection 7 has to be moved in order to secure base plate 2 to lower retaining plate 4. Typically, base plate 2 of FIG. 4 is pushed parallel to lower retaining plate 4 in the direction opposite the arrow to secure it in place or parallel to the retaining plate in the direction of the arrow to release it. In this way, base plate 2 can be detached from lower retaining plate 4 and removed without the use of tools.

Figure 5:
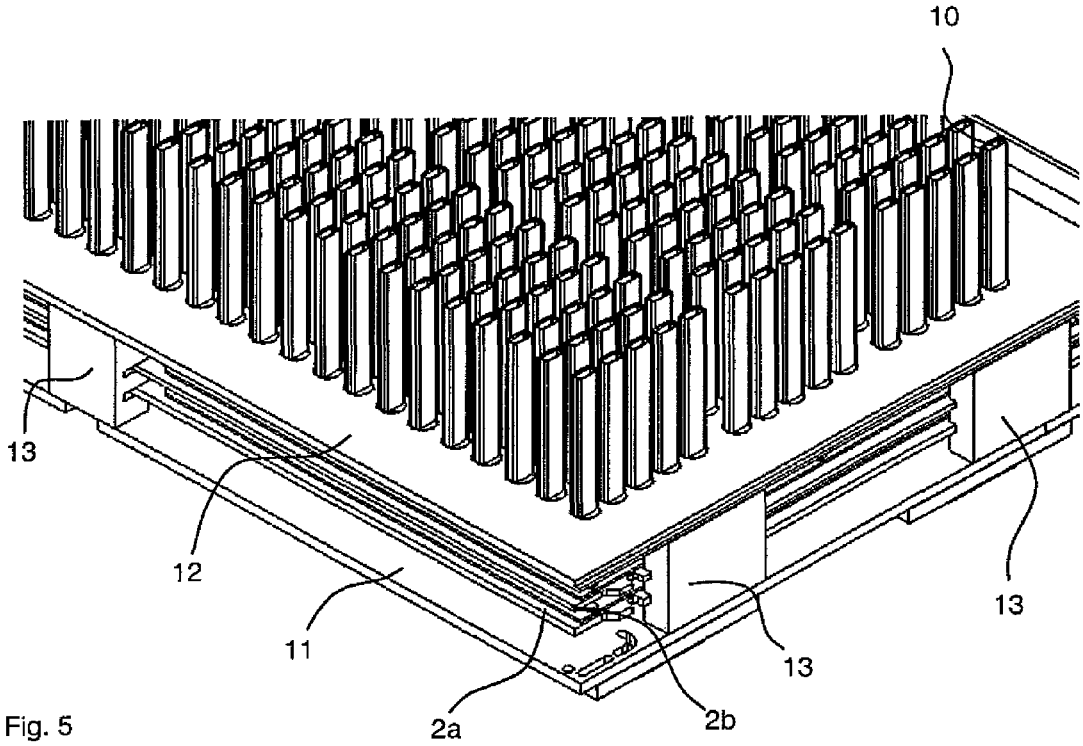
FIG. 5 is a perspective view of a feed and sorting device having a blocking slide unit and guide parts according to a third exemplary embodiment.

FIG. 5 shows a blocking slide unit according to a third exemplary embodiment of the present invention, wherein the components which are the same as those of the first and second exemplary embodiments are designated by the same reference numbers. For a detailed description of them, reference is made to the corresponding descriptive sections. The blocking slide unit according to the third exemplary embodiment comprises, instead of one base plate 2, a corresponding lower base plate 2*a* with lower through-openings and a corresponding upper base plate 2*b* with upper through-openings. Lower base plate 2*a* and upper base plate 2*b* are arranged with respect to each other in the operating state in such a way that in each case a lower through-opening and a corresponding upper through-opening are assigned to an appropriate number of filling tubes 10. Because of their support in guide parts 13, the base plates can be moved with precision in the blocking slide unit.

Figure 6:
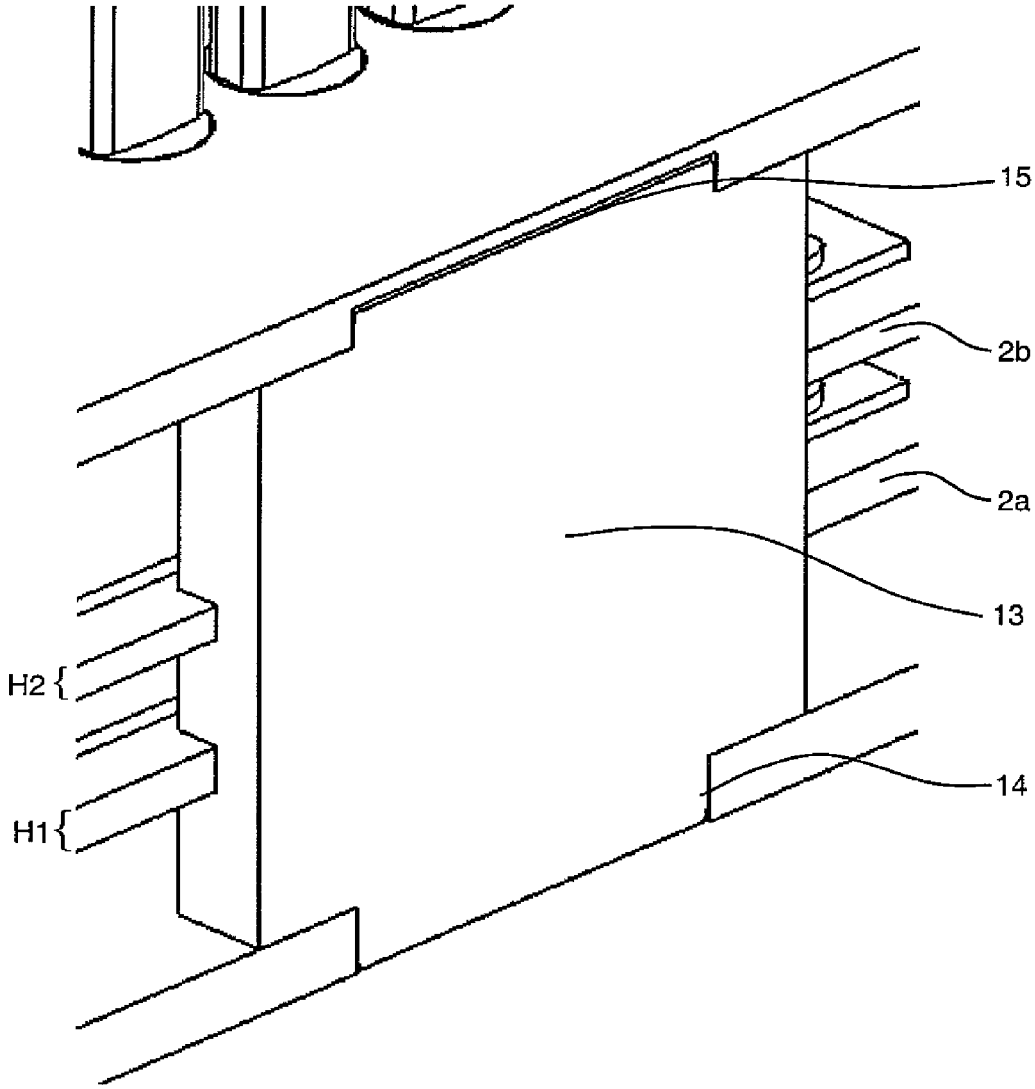
FIG. 6 is an enlarged perspective view of the guide part of a blocking slide unit according to a fourth exemplary embodiment in the state in which the guide part is installed in the blocking slide unit.

FIG. 6 is an enlarged perspective view of guide part 13 in a blocking slide unit according to a fourth exemplary embodiment, wherein the components which are the same as those of the first, second, and third exemplary embodiments are designated by the same reference numbers. For a detailed description of them, reference is made to the corresponding descriptive sections.

It can be seen in FIG. 6 that guide parts 13 can have different codings both for the connection with an upper cover plate and for the connection with a lower cover plate and also for the guidance of lower base plate 2*a* and of upper base plate 2*b*. Lower base plate 2*a* comprises a first height H1, and upper base plate 2*b* comprises a second height H2, wherein the first height H1 differs from the second height H2. Upper recess 15 in upper cover plate and lower recess 14 in the lower cover plate are of different shape. It is possible, for example, for lower recess 14 to extend over the entire height of the lower cover plate, whereas upper recess 15 extends over only a portion of the height of the upper cover plate. In addition to the height, the width and the length of the recesses can also be different. To establish the proper connection, an upper guide projection 16, which fits into upper recess 15, is formed on the top surface of guide part 13, and a lower guide projection 15, which fits into lower recess 14, is formed on the bottom surface of guide part 13. The asymmetry of the lower and upper guide projections ensures that the guide parts will be assembled correctly.

Figure 7:
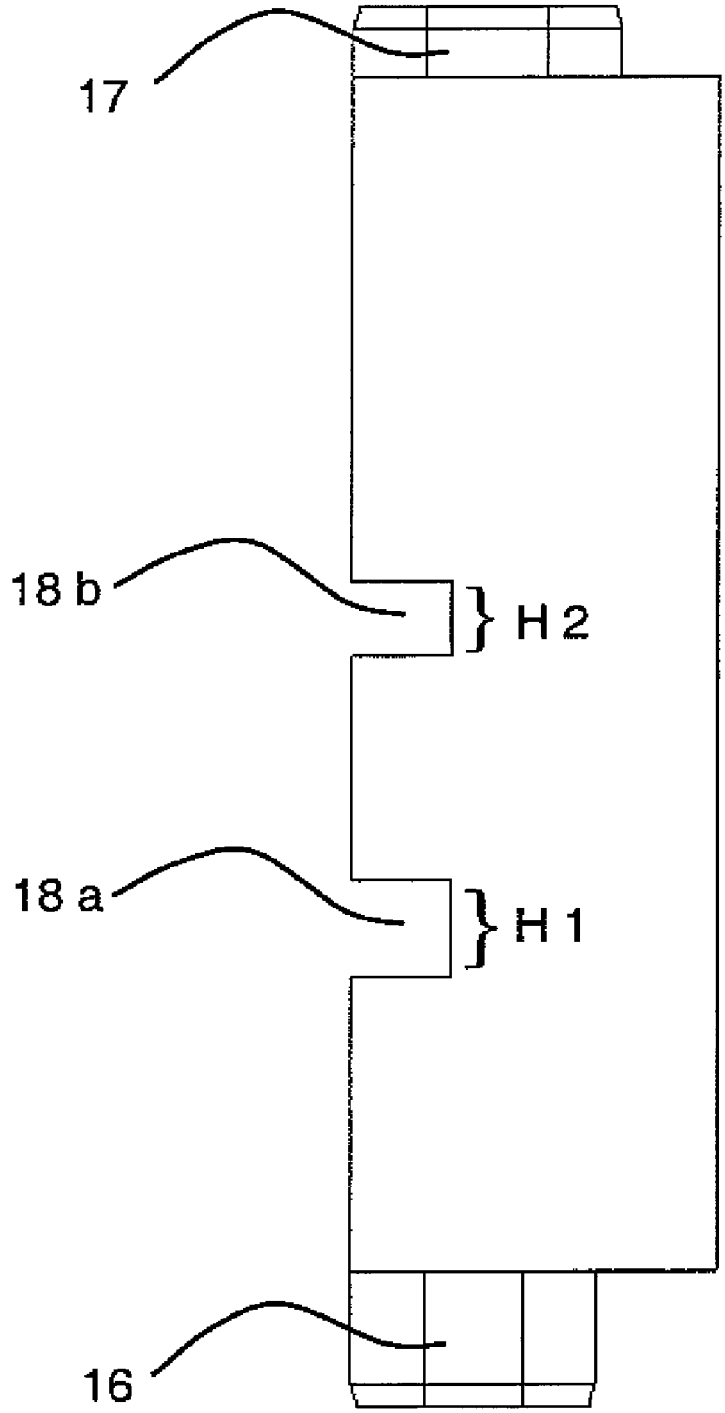
FIG. 7 is an enlarged cross-sectional view of the guide part of FIG. 6.

FIG. 7 shows that the lower guide is designed as a lower guide groove 18*a* with a width B1 which accommodates the first height H1, and that the upper guide is designed as upper guide groove 18*b* with a width B2 which accommodates the second height H2. The asymmetry of the lower and upper guide grooves together with the asymmetry of the lower and upper base plates provides a mechanical way of preventing the base plates from being confused with each other during assembly.

Figure 8:
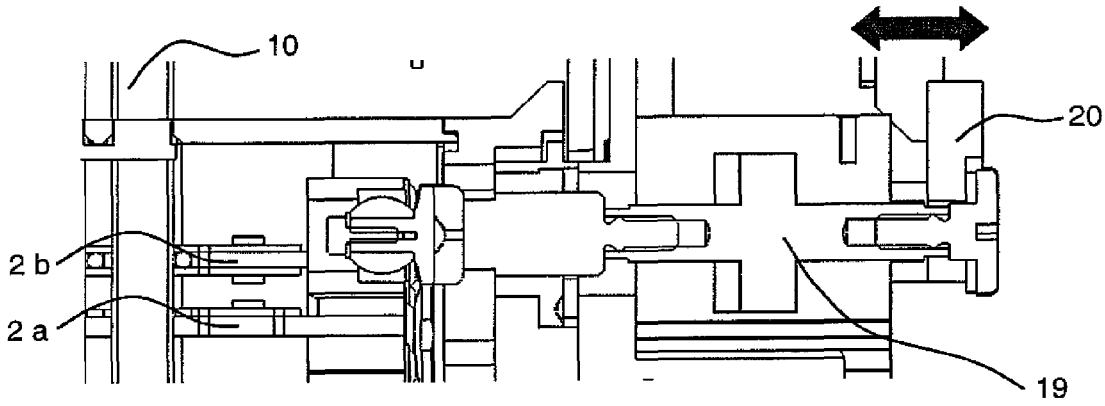
FIG. 8 is a schematic cross-sectional view of a blocking slide unit according to a fifth exemplary embodiment.

FIG. 8 is a cross-sectional view of a blocking slide unit according to a fifth exemplary embodiment, in which upper base plate 2*b* is arranged so that it can be adjusted, wherein the components which are the same as those of the first, second, third, and fourth exemplary embodiments are designated by the same reference numbers. For a detailed description of them, reference is made to the corresponding descriptive sections.

End position of the upper base plate 2*b* is adjustable, so that the tablets in filling tubes 10 can be blocked off in optimal fashion. The adjusting distance is preferably continuously variable. This can be accomplished by the use of a motor. Upper base plate 2*b* is moved by a pneumatic cylinder 19, which comprises a continuous piston rod. A stop 20 can be used to set the desired position, wherein the stop can be adjusted by the motor, so that no manual interventions are required.

The technical features of the exemplary embodiments 1-5 can be combined with each other. It is also possible to replace base plate 2 by a number of partial base plates or to replace upper base plate 2*b* by a number of upper partial base plates and lower base plate 2*a* by a number of lower partial base plates.

What is claimed is:

1. A feed and sorting device for tablets, capsules or dragées, comprising:

a number of vertically extending filling tubes, each tube having a guiding channel for tablets, capsules or dragées; and a blocking slide unit for temporarily blocking the guiding channels of the filling tubes, the blocking slide unit comprising:

a base plate with through-openings for the filling tubes;

a lower retaining plate, above which the base plate is arranged and to which at least one fastening means for fastening the base plate to the lower retaining plate is attached, the fastening means including a locking projection, and wherein a locking and release opening in the base plate is assigned to the locking projection in such a way that, by shifting the lower retaining plate relative to the base plate, the lower retaining plate is either detachable from the base plate or lockable on the base plate; and a plurality of blocking fingers designed as integral parts of the base plate and horizontally extending into the through-openings, each blocking finger being assigned to one of the filling tubes.

2. The feed and sorting device of claim 1 wherein the plurality of blocking fingers extends into each of the through-openings in the base plate.

3. The feed and sorting device of claim 1 wherein the base plate and the blocking fingers are formed of a solid material.

4. The feed and sorting device of claim 3 wherein the solid material is steel, aluminum, or plastic.

5. The feed and sorting device of claim 3 wherein the base plate and the blocking fingers comprise a soft coating.

6. The feed and sorting device of claim 5 wherein the soft coating is a silicone coating.

7. The feed and sorting device of claim 1 wherein the base plate and the blocking fingers are formed of a soft material.

8. The feed and sorting device of claim 7 wherein the soft material is silicone.

9. The feed and sorting device of claim 1 wherein the base plate is formed of a number of partial base plates.

10. The feed and sorting device of claim 1 wherein the blocking slide unit comprises an upper and a lower base plate arranged parallel to each other such that the through-openings of the upper and lower base plates are at least partially aligned with each other.

11. A feed and sorting device for tablets, capsules or dragées, comprising:

a number of vertically extending filling tubes, each tube having a guiding channel for tablets, capsules or dragées; and a blocking slide unit for temporarily blocking the guiding channels of the filling tubes, the blocking slide unit comprising:

a base plate with through-openings for the filling tubes;

an upper retaining plate, below which the base plate is arranged, wherein at least one fastening means for fastening the base plate to the upper retaining plate is attached to the base plate fastening means including a locking projection, and wherein a locking and release opening in the upper retaining plate is assigned to the locking projection in such a way that, by shifting the base plate relative to the upper retaining plate, the base plate is either detachable from the upper retaining plate or lockable on the upper retaining plate; and a plurality of blocking fingers designed as integral parts of the base plate and horizontally extending into the through-openings, each blocking finger being assigned to one of the filling tubes.

12. A feed and sorting device for tablets, capsules or dragées, comprising:

a number of vertically extending filling tubes, each tube having a guiding channel for tablets, capsules or dragées; and a blocking slide unit for temporarily blocking the guiding channels of the filling tubes, the blocking slide unit comprising:

a base plate with through-openings for the filling tubes;

a retaining plate having fastening means for fastening the base plate to the retaining plate;

the base plate or the retaining plate having a locking projection;

a locking and release opening associated with the locking projection in such a way that, by shifting the retaining plate or the base plate, the retaining plate is either detachable from the base plate or lockable on the base plate; and a plurality of blocking fingers designed as integral parts of the base plate and horizontally extending into the through-openings, each blocking finger being assigned to one of the filling tubes.

* * * * *